United States Patent [19]

Utley et al.

[11] Patent Number: 4,786,382

[45] Date of Patent: Nov. 22, 1988

[54] ELECTROCHEMICAL TREATMENT OF LIGNINS

[75] Inventors: James H. P. Utley, London; Carment Z. Smith, Essex, both of England

[73] Assignee: The Minister of Agriculture, Fisheries and Food in Her Britannic Majesty's Goverment of the United Kingdom of Great Britain and Northern Ireland, London, England

[21] Appl. No.: 76,933

[22] PCT Filed: Nov. 12, 1986

[86] PCT No.: PCT/GB86/00699

§ 371 Date: Aug. 18, 1987

§ 102(e) Date: Aug. 18, 1987

[87] PCT Pub. No.: WO87/03014

PCT Pub. Date: May 21, 1987

[30] Foreign Application Priority Data

Jul. 13, 1985 [GB] United Kingdom ..... 8527960

[51] Int. Cl.[4] ..... C25F 5/00

[52] U.S. Cl. ..... 204/132

[58] Field of Search ..... 204/132

[56] References Cited

U.S. PATENT DOCUMENTS 775,829 11/1904 Kitsee ..... 204/132

2,828,253 3/1958 Kurz ..... 204/132

OTHER PUBLICATIONS

Chemical Abstracts, vol. 88, 1978, E. I. Kovalenko et al., "Electrochemical Oxidation of the Natural Polymer Lignin", p. 111, No. 154596C.

*Primary Examiner*—R. L. Andrews

*Attorney, Agent, or Firm*—Stevens, Davis, Miller & Mosher

[57] ABSTRACT

Lignin is cleaved electrolytically into smaller molecules than the starting lignin by passage of electric current through an aqueous alkaline solution of lignin at a temperature above 100° C. while mixing. The yield is greater than 6%.

12 Claims, 3 Drawing Sheets

ELECTROCHEMICAL TREATMENT OF LIGNINS

This invention relates to an electrochemical process for the electrochemical oxidative degradation of lignins and related substances, and to an electro-chemical cell in which the process may be performed.

Lignin is, after cellulose, the principal constituent of the woody structure of higher plants. About 25% of dry wood consists of lignin, in part deposited in the xylem cell walls and in part located in the intercellular spaces, where it may constitute as much as 70% of the solid materials present.

The exact chemical structure of lignin, either in wood, where it is usually bonded to plant polysaccharides, or when separated from other wood substances, is not fully known. Much is known however about the structure of certain isolated lignines. For example the lignin isolated from coniferous trees is though to be a polymer resulting from enzymically induced oxidation of coniferyl alcohol.

Lignins appear to be constructed of phenylpropane units, substituted princiaplly by methoxy and hydroxy groups, and joined in a polymeric structure by various types of linking groups.

The most common types of substituted phenylpropane units in both coniferous and deciduous lignins are hydroxyphenylpropane (i), syringylpropane (ii) and guaiacylpropane (iii) units:

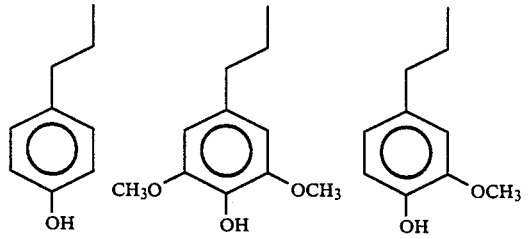

(i) (ii) (iii)

The relative proportions of these three units vary between coniferous and deciduous lignins, eg coniferous lignin contains about 14% (i), 7% (ii) and 79% (iii), whereas deciduous lignins contain about 3 of (ii) to 2 of (iii). As well as the methoxy and hydroxy groups, smaller quantities of other minor functional groups may also be present on these units.

The phenylpropane units in lignin are linked mainly by carbon-carbon bonds and by ether linkages. Spectroscopic data suggest that about 25% of the units are linked as biphenyl linkages. The phenolic oxygen in about 66% of the units is present as an ether linkage.

Some examples of typical linkages are shown below together with the approximate percentages to which they occur in a typical lignin structure.

(iv)

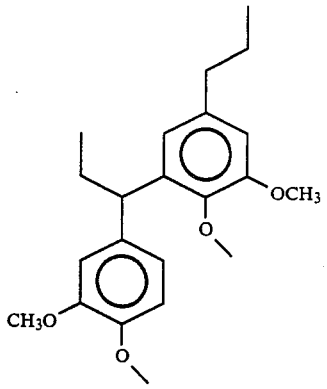

(ca. 7%)

(v)

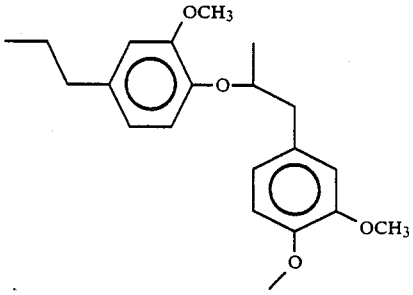

(ca. 48%)

(vi)

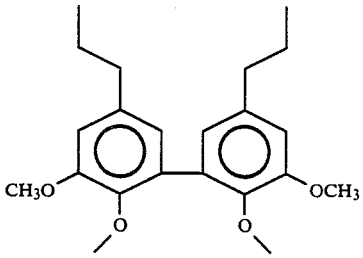

(ca. 9–12%)

(vii)

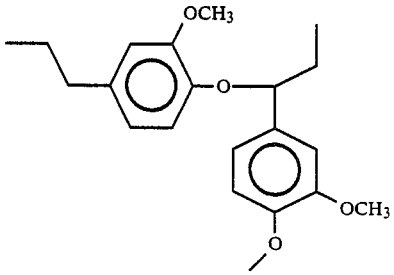

(ca 6–8%)

-continued (viii)

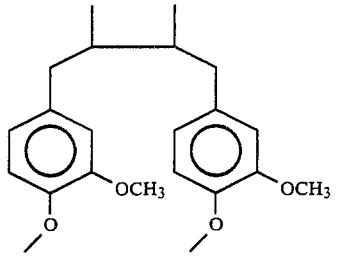

(ca. 9-12%)

But a wide variety of other linkages probably also exist in lignins, particularly between the propyl chains to form cyclic species such as cyclic ethers, such as ix and x below:

(ix)

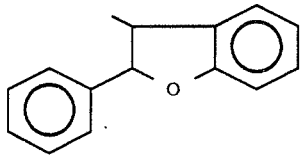

(x)

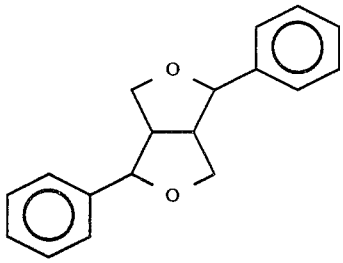

By means of such linkages the phenylpropane units are linked into a large polymeric structure, probably randomly linked. Average molecular weights for coniferous lignin is over 10,000, whilst the average molecular weight of deciduous lignin probably does not exceed 5000.

A suggested structure for coniferous lignin incorporating such bonding is shown in Kirk-Othmer 'Encyclopaedia of Chemical Technology' 2nd Edn, Vol 12 (1967) p 367.

Millions of tons of lignins are potentially available annually from industry, such as wood and bark wastes from the lumber industry, the match industry, and particularly from the wood pulp and paper industries.

In the pulp industry lignin is usually obtained as dissolved lignosulphonic acid or as lignosulphonate salts as a result of cooking wood chips under pressure in the presence of aqueous sulphurous acid or sulphites, which leaves the cellulose as a residue for example for paper making. From the solution the acid or salt may be obtained by drying.

From these lignosulphonates, alkali lignate salts may be prepared by hydrolysis using aqueous hydroxides, especially sodium and calcium hydroxides. Alkali lignates may also be prepared directly from wood chips by cooking them with sodium hydroxide, optionally with a little sodium sulphide present. These lignates are almost free from non-lignin organic constituents but may contain a little combined sulphur if they have been prepared from the sulphonates or if sodium sulphide has been used.

Another source of lignin which is likely to become of increasing importance is straw. Millions of tons of straw are wasted each year, eg by burning. Straw contains about 16% of lignin. Although straw lignin is built up of the units discussed above, it has a slightly different structure to wood lignin. Straw lignin may be extracted chemically eg by sodium hydroxide or sodium sulphite treatment, in much the same way as wood lignin.

Lignin may also be extracted from plants eg wood and straw by treatment of the plant in a suitable form such as woodchips, with phenol at a temperature of around 110° C. These conditions hydrolyse hemicelluloses and leave the lignin in a conveniently solublized form known as "organosolv lignin" which is commercially available. Organosolv lignin generally has a molecular weight of around 2000 to 5000, and has a lignin structure as discussed above but with some of the methoxy ring substituents removed. Another commercial process used hydrogen fluoride to extract lignin from plants, in a form known as "HF lignin".

As is well known, under pressure and temperature, over a geological period of time, plants are gradually converted into coal, with a corresponding gradual change of chemical structure, including the gradual dissappearance of lignin. In certain coals, including peats, soft brown coals, dull brown coals, bright brown coals, bituminous hard coals and sometimes even anthracites, lignin will be present, but in ever decreasing amounts. Lignin may be extracted from coals which contain it by methods similar to those described above, with varying degrees of success, and for the purposes of this description the term "lignite" or "lignitic coal" will be used for coals from which lignin may be extracted.

The term "lignin" used herein, unless otherwise stated, refers to all forms of lignin.

Lignin and its derivatives such as sulphonate are very useful in a number of industries such as in leather tanning and concrete (as dispersants), in which they are used directly. Lignin may also be chemically degraded, for example by thermal degradation, alkaline fusion, pressure hydrogenation and oxidation to yield valuable organic chemicals, especially the flavouring agent vanillin, (4-hydroxy-3-methoxybenzaldehyde) (xi).

(xi)

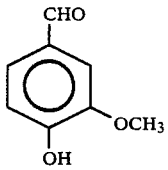

The most widely used methods for oxidation of lignin use nitrobenzene, metal oxides such as of copper, mercury, silver and cobalt, molecular oxygen in alkaline solution, peracetic acid or acidic hydrogen peroxide, sodium hypochlorite, chlorine dioxide or sodium chlorite as oxidising agents. To a lesser extent dichromates, permanganates and ozone have been used.

The use of each of the above oxidising agents presents problems. Nitrobenzene is expensive and is itself oxidised to highly undesirable (eg in the food industry) by-products including aniline, azobenzene and 4-hydroxy azobenzene among others. As well as their toxicity, the presence of these organic by-products adds to the difficulty of separation of the desired products.

Metal oxides are also expensive, may be toxic, are difficult to recover and often oxidise the products of lignin degradation further. Oxygen must be used at elevated temperatures and temperatures which are potentially hazardous and may cause overoxidation. Peracetic acid and hydrogen peroxide are expensive and cause overoxidation eg to carboxylic acids. The chlorine based oxidants are corrosive and dangerous ($ClO_2$ is explosive) and give unstable products which are difficult to characterise. Dichromates, permanganates and ozone cause degradation of the aromatic nucleus of lignins to lower molecular weight products of less value.

There has been some work on electrochemical oxidation of lignins (Refs 1 to 4) at temperatures around ambient and below 80° C., but the results were discouraging and appeared to achieve little more than modifying the lignin molecule by cleavage of the side chain to increase the —OH and $CO_2H$ content. The reported yields of useful low molecular weight products such as vanillin and vanillic acid were very low, eg ca 2–3%, which could be attributed to alkaline pre-treatment causing cleavage, and subsequent oxidation of the small phenolic fragments to aldehydes and acids.

The same workers, using Ni, Ni peroxide and glassy carbon, found that anodic oxidation of lignin in an alkaline medium gave no significant cleavage of the lignin at ambient temperature, and an increase to a still relatively useless 2–6% cleavage at 110° C. Over such a temperature change it would be expected that a considerable increase in yield would be obtained.

Further discouragement is found in the tendency for anticipated monomers to form multicomponent mixtures of polymeric products even at room temperatures.

It is an object of the present invention to provide a method of oxidative degradation of lignin which avoids the disadvantages of the prior art processes and which provides advantageous conditions of electrochemical oxidation. Other objects and advantages will become apparent from the following description.

According to the present invention, a process for the electrolytic cleavage of lignin at a yield greater than 6% comprises passing an electric current through an aqueous alkaline soluton of the lignin at a temperature above 100° C. whilst maintaining mixing of the solution. Yields of 10% or more may be achieved by the process.

Using the process of the invention under the conditions discussed below efficient electrolytic cleavage of the lignin occurs, and this cleavage may be complete ie to provide useful compounds including monocyclic compounds such as vanillin (xi), or partial, so as to produce dimers, trimers or higher oligomers of monocyclic species which may also be useful.

The process of the invention is normally carried out in an electrochemical cell provided with electrodes between which the electric current is passed and which is adapted to withstand the corrosive effects of the hot alkali solution, the temperature and consequent pressure. Suitable cell designs will be apparent to those skilled in the art, and the inventors have found that a stainless steel cell, lined with Teflon (trade mark), is suitable. The cell should be sealed to avoid boiling of the water and should be fitted with a safety valve in case of overpressure. The above layout is entirely conventional.

On an industrial scale, the process may be carried out in electrolytic cells of conventional design, eg flow cells, and the construction of cells to withstand the conditions of the process would present no problem whatever to a chemical engineer skilled in the art. The principles discussed herein with respect to laboratory or pilot scale cells are entirely applicable with adjustment to scale to an industrial plant.

A preferred alkali is sodium hydroxide, but other alkali metal hydroxides could also be used, a preferred concentration being 2.5–3.5M. Lower concentrations may be used, but the efficiency of the process reaches a plateau at this concentration and no advantage is usually gained by the use of more concentrated alkali.

The lignin may be made up into the aqueous alkali either by using the lignin itself, or by using a compound of lignin which is capable of being hydrolysed under the alkaline conditions of the solution, either at ambient or eleva ted temperatures, into soluble lignin or into a lignate salt. For example a lignin sulphonate or sulphonic acid may be used. It may also be possible to use certain lignites in the process, provided that these are well crushed and the design of the cell is such that the presence of solid lignites will not interfere with its operation. Similarly it may be possible to use vegetable matter which contains lignin eg straw, in the process of the invention without any prior extraction of the lignin. In this case too the possible problem of the solid residue should be noted. Filters in the cell eg in the case of a flow cell could be used. The lignin present or formed in the alkaline solution may be converted under the alkaline conditions into a lignate salt, and therefore these too may be used to make up the solution. Lignins and lignin compounds from coniferous, deciduous and other sources may be used. Some commercially available lignins may be insoluble in the alkali used, eg HF lignin may be, and this should be checked beforehand.

The concentration of lignin present in the solution has an upper limit determined by solubility and viscosity, as at high concentrations the solution may become too thick to mix efficiently. Prehydrolysis of the lignin prior to electrolysis may help to solubilise the lignin, reduce the viscosity, and increase the efficiency of oxidation and thus the yield of useful products after electrolysis. Typically in prehydrolysis lignin is heated in the presence of an alkali metal hydroxide under conditions similar to those of the subsequent electrolysis ie aqueous solution above 100° C. A preferred temperature range is 170°–180° C. for a suitable period eg 2–4 hours prior to electrolysis but times and conditions are variable. This prehydrolysis may conveniently be performed in the electrolytic cell prior to passing the current. Successful electrolytic oxidative cleavage in the process of the invention was obtained using 1–2 wt% of lignin in the solution. If a lignin compound such as a ligninsulphonate is used, which is hydrolysed under the reaction conditions or prehydrolysed, the amount of such a compound used should not exceed the stoichiometric amount which can be hydrolysed by the amount of alkali present.

The efficiency of the process is increased by increasing the temperature, and a temperature of 170°–190° has been found to be optimum with no practical advantage in using a higher temperature. Below 100° C. the efficiency of the process is generally too low to be worthwhile.

An importance factor in attaining a high yield of the desired low molecular weight cleavage products is the need to mix the solution during the course of the process. This may be achieved by any conventional mixing or stirring mechanism, eg on a small scale by using a stirrer in the cell, or on an industrial scale by a stirrer or a conventional cycling pump. Means for mixing the solution will be apparent to those skilled in the art.

A direct current is passed between the electrodes of the cell. It is preferred to use a low current density so that hydrogen and oxygen evolution are minimised for safety reasons (this mixture of gases is explosive) and to maximise the current efficiency of cleavage by oxidative degradation of the lignins. The cell voltage appears to be less critical than current density, the lowest possible voltage to achieve cleavage of the lignin with the cell design used is generally preferred. The cell is normally set up and the voltage adjusted to achieve this.

The desirability of a current density as low as possible whilst maintaining cleavage also influences the electrode design. The anode should be of large surface area to achieve this, and may thus for example be in the form of a gauze. When the anode is a gauze, the optimum current density is in the range of 0.2–10 $mAcm^{-2}$ quoted in terms of the nominal surface area of the gauze. With an anode of other geometry a similar figure of current density would apply. Above 10 $mAcm^{-2}$ over oxidation begins to occur leading to the formation of gaseous products and around 4 $mAcm^{-2}$ eg 3–5 mA $cm^{-2}$ appears to be optimum. The electrodes may be made of the variety of conventionally used electrode materials which are capable of resisting hot alkali. For the cathode, among others, nickel, copper, vitreous carbon and lead have been found suitable. To minimise hydrogen evolution from the cathode it is preferred to use a cathode material with a high hydrogen overpotential, and for this reason lead is preferred although nickel is preferred if the products are for human or animal consumption due to the possibility of contamination with lead. For the anode, among others copper, vitreous carbon and nickel have been found suitable. Nickel has been found to be particularly effective at resisting corrosion and in giving a good yield of degradation products, and is preferred, especially in the form of a gauze.

Various electrode geometries will be apparent to those skilled in the art with the intention of producing a cell with a low current density at convenient working voltages and for electrolysing as large a volume of the cell contents as possible. A suitable electrode geometry utilises a central rod anode and a concentric cylindrical cathode, or gauzes in a "Swiss roll" configuration of the anode and cathode such that the gauzes are rolled up together in a cylindrical manner, the two electrodes being separated from one another by some insulating means such as Teflon (trade mark) mesh. Other insulating means and electrode geometries (for example a cylindrical anode surrounding a rod cathode) will be apparent to those skilled in the art, and adoptation to an industrial scale would present no problem.

The time for which the process is carried out will depend of course upon the cell dimensions, concentration, temperature etc, and the yield from the degradation which is considered viable.

After the process of the invention has been carried out, the degradation products may be extracted from the aqueous solution by essentially conventional means. For example the hot alkaline solution is cooled to ambient temperature, acidified with an acid which does not affect the desired products, eg hydrochloric acid, extracted with an organic solvent, eg chloroform, which may then be neutralised, dried and evaporated to yield the product in a conventional way.

The products of the process may include a variety of useful compounds, such as vanillic acid (4-hydroxy-3-methoxybenzoic acid), 4-hydroxy-benzaldenhyde, vanillin, 4-hydroxyacetophenone, acetovanillone (4-hydroxy-3-methoxyacetophenone) and others, These compounds may be separated from the crude yield by processes apparent to the chemist, eg on a lab scale by chromatography and on an industrial scale by well established methods. The proportions of the various compounds present will depend upon the type of lignin used, and electrolysis conditions.

The process of the invention provides a number of advantages over prior art processes as well as the possibility of fine control of the product discussed above. The aqueous alkaline electrolyte is cheap and presents no undue problems of disposal. No additional undesirable chemical oxidants need be present, and the problem of isolating these from the reaction mixture, and the possible dangers from their use and avoided. As well as these advantages, the reaction conditions (temperature, pressure, current density) and relatively mild and easily controlled, and the process can be carried out at a large (industrial) scale with readily available simple equipment as conventionally used in the electrolysis art. Over previous electrochemical oxidation processes the invention provides an advantageous set of electrolysis conditions which attain a very substantially improved yield. Although many of the products mentioned above may be obtained from other sources, eg the petrochemical industry the price of oil is subject to unpredictable fluctuation, and the invention provides a potential alternative.

Although described herein with reference to lignins and compounds related to lignins it is to be expected that the process of the invention will be applicable to the electrochemical oxidation of a wide range of natural products to yield useful degradation products, such as in particular the oxidation of soluble celluloses to hemicelluloses or of soluble polysaccharides eg sugars to glyoxals and carboxylic acids.

BRIEF DESCRIPTION OF THE DRAWINGS

The process of the invention will now be described by way of example only with reference to the accompanying FIGS. 1 and 2 and 3 which show cutaway views of two electrochemical cell in which the process may be carried out.

DETAILED DESCRIPTION OF THE DRAWINGS

Figure 1:
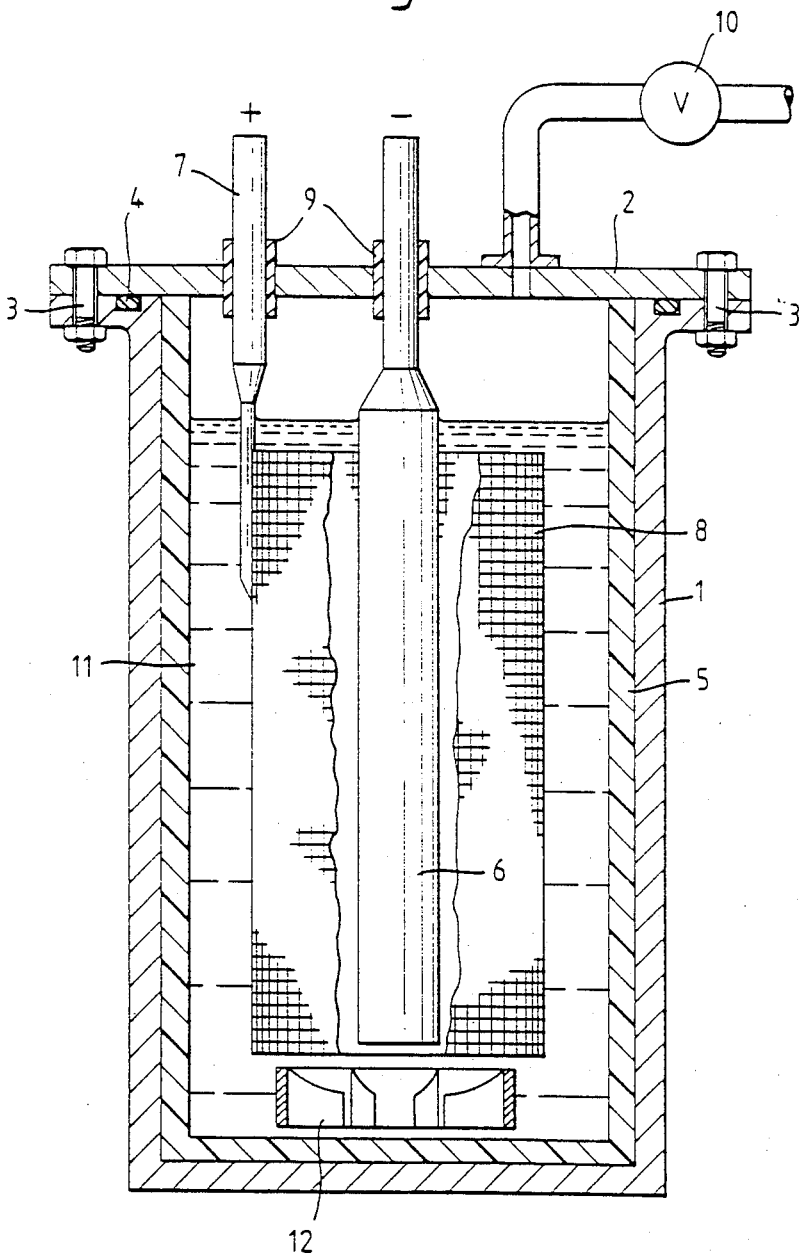

Referring to FIG. 1 an electrochemical cell comprises a stainless steel vessel (1) closed with a stainless steel lid (2) held in position against internal pressure by bolts (3) the seal being maintained by 'O' rings (4). The interior of the vessel (1) is lined with Teflon (trade mark) (5). Through the lid (2) pass a cathode (6) in the form of a lead rod, and an anode connector (7) connected to a nickel gauze anode (8) in the form of a cylinder completely encircling the cathode (6). Insulation and airtightness where the cathode (6) and anode connector (7) pass through the lid (2) are maintained by Teflon (trade mark) sleeves (9). The lid (2) is also fitted with a safety valve and means for releasing pressure, shown conventionally (10). Within the vessel (1) is contained an alkaline solution of lignin (11), which is stirred by a magnetic stirrer (12) in the form of a cylinder with internal propellor blades, operated by a stirring unit (not shown) outside the cell. In use the vessel (1) and contents (11) are heated to and maintained at the operating temperature by an external heater (not shown).

Figure 2:
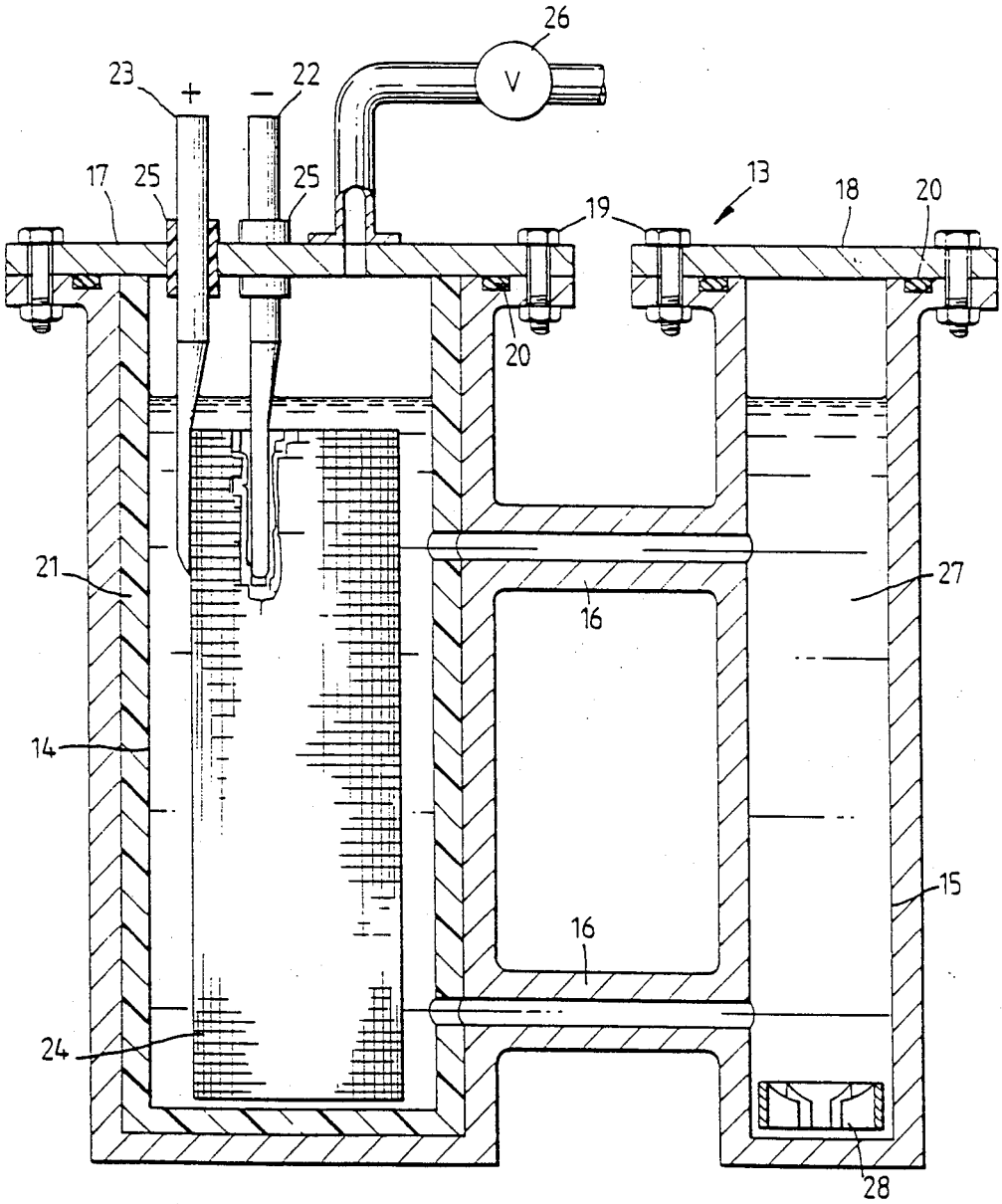
Figure 3:
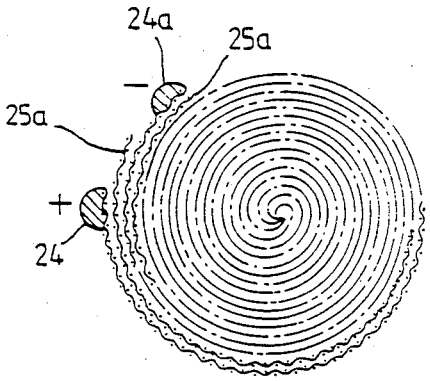

Referring to FIGS. 2 and 3, an electrochemical cell comprises a stainless steel vessel (13) designed so that is has two main chambers (14) and (15) which are joined together by two ducted pipes (16). The chambers (14) and (15) are closed with two stainless steel lids (17) and (18) which are held in position against internal pressures by bolts (19) the seal being maintained by 'O' rings (20). The chamber (14) of the cell is lined with Teflon (trade mark) (21). Through the lid (17) pass a cathode connector (22) and an anode connector (23) which are connected to a "Swiss roll" arrangement of nickel gauze anode (24) and cathode (24*a*). The anode and cathode are separated by a Teflon (trade mark) mesh (25*a*). Insulation and airtightness where the connectors for anode and cathode pass through the lid (17) is maintained by Teflon (trade mark) sleeves (25). The lid (17) is also filled with a safety valve and means for releasing pressure shown conventionally (26). Within the vessel (13) is contained an alkaline solution of lignin (27), which is stirred by a magnetic stirrer (28) contained in the chamber (15). In use the vessel (13) and contents (27) are heated to and maintained at the operating temperature by an external heater not shown. This type of cell illustrates the possibility of a flow type of cell in which electrolyte is rapidly circulated through the system thus maintaining stirring.

EXAMPLE 1

Organosolv lignin extracted by phenol from spruce (conifer) (0.25 g) was dissolved in aqueous sodium hydroxide (25 ml, 3M) and introduced into the cell shown in FIG. 1 prior to sealing. The cell had a capacity of ca 35 ml and had a nickel gauze anode of mesh size 40 with a nominal surface area 18 $cm^2$. The cell was heated to 170° C. and electrolysis was contanued at 70 mA for 4 hours, during which $10^3$ coulombs was passed. The voltage required was always less than 5 V, usually 1.8–2.0 V. The cell was then cooled, pressure released, and the contents decanted off. The contents were then acidified to pH2 with hydrochloric acid. The acid mixture was shaken with chloroform ($3\times70\times1$) and the chloroform layer separated off, neutralised with sodium carbonate and dried with sodium sulphate.

Filtration and evaporation yielded a light brown semi-solid product (0.072 g, 28% yield by weight) using a more efficient stirrer a 36% yield was obtained. Analysis of this product by chromatrographic methods showed that the major products were:

| Identification | Relative yield mole % |
|---|---|
| Vanillic acid | 19 |
| 4-hydroxhbenzaldehyde | 51 |
| vanillin | 17 |
| 4-hydroxyacetophenone | 9 |
| acetovanillone | 4 |
| (plus 2 unidentified products) | |

The experiment was repeated using other anode and cathode materials. This was found to affect the yield, all other conditions being equal, as below:

| Anode | Cathode | Yield (%) |
|---|---|---|
| Copper | Copper | 15–20 |
| Nickel | Copper | 17–20 |

-continued

| Anode | Cathode | Yield (%) |
|---|---|---|
| Nickel | Lead | 20–36 |

EXAMPLE 2

Phenol extracted spruce lignin (obtained from Battelle) (0.30 g) was dissolved in aqueous sodium hydroxide (60 ml, 3M) and introduced into the cell, shown in FIG. 2, prior to sealing. The cell had a capacity of about 80 ml and had a nickel gauze anode of mesh size 40 with a nominal surface area of about 100 $cm^2$. The cathode made of lead and anode were arranged in the above mentioned Swiss roll configuration with Teflon (trade mesh) to separate them. The cell was heated to 170° C. and electrolysis was carried out at 300 mA for 3 hours during which time $3\times10^3$ coulombs was passed. The voltage required was always less than 5 V, usually 1.8–2.0 V. The cell was then cooled, pressure released and the contents decanted off. The resulting solution was then acidified to pH2 with hydrochloric acid. The acidic mixture was shaken with chloroform ($3\times70$ ml) and the chloroform layer separated off, and fried with sodium sulphate.

Filtration and evaporation yield a light brown semi-solid organo-solv product (0.102 g, 34% by weight). Analysis of this product by chromatography showed that the major products, corresponding to 26% yeild based on a lignin formula of $(C_{10}H_{13}O_4)_n$, were:

| Products | Relative Yield (%) |
|---|---|
| Phenol | 3 |
| P(OH)benzaldehyde | 42 |
| Vanillie acid | 5 |
| P(OH)acetaphenone | 12 |
| Vanillin | 28 |
| Aceto vanillone | 5 |
| Syringaldehyde | 4 |

EXAMPLE 3

Phenol extracted straw lignin (obtained from Battelle) (0.260 g) was electrolysed and worked up following the procedure described in Example 2 above. A crude light orange mixture (0.073 g, 28% by weight) was obtained and analysed by chromatography to show that the major products were:

| Products | Relative Yield % |
|---|---|
| Phenol | 4 |
| P(OH)benzoic acid | 4 |
| P(OH)benzaldehyde | 39 |
| Vanillic acid | 9 |
| P(OH)acetophenone | 9 |
| Vanillin | 21 |
| Syringic acid | 2 |
| Acetovanillone | 3 |
| Syringaldehyde | 9 |

EXAMPLE 4

Organosolv spruce lignin (0.40 g) was electrolysed following the procedure of Example 2, but with a nickel anode and nickel cathode. A yellow semi-solid crude material (0.050 g, 13% by weight) was obtained. Chromatographic analysis of the material showed:

| Products | Relative Yield (%) |
|---|---|
| Phenol | 4 |
| Vanillic acid | Traces |
| Acetovanillone | 14 |
| Vanillin | 80 |
| Syringaldehyde | Traces |

corresponding to about 14% overall yield.

EXMAPLE 5

Organosolv Bagasse (0.100 g ) was electrolysed using the procedure described in Example 2. A light orange solid (0.028 g, 28% by weight) was obtained. Analysis of this by chromatography showed the following product distribution

| Product | Relative Yield (%) |
|---|---|
| Phenol | 37 |
| P(OH)benzoic acid | 8 |
| Vanillic acid | 4 |
| Syringic acid | Traces |
| P(OH)benzaldehyde | 7 |
| Vanillin | 9 |
| P(OH)acetophenone | 8 |
| acetovanillone | 6 |
| Syringaldehyde | 5 |

Corresponding to 26% overall yield.

EXAMPLE 6

Kraft aspen lignin (0.40 g) was electrolysed following the procedure of Example 2, but with a nickel anode and nickel cathode. A light orange solid material (0.040 g, 10% by weight) was obtained which on chromatographic analysis showed the following product distribution:

| Product | Relative Yield (%) |
|---|---|
| Syringic acid | Traces |
| P(OH)benzoic acid | Traces |
| Vanillin | 49 |
| Acetovanillone | 12 |
| Syringaldehyde | 40 |

REFERENCES

1. V. D. Davydov et al 'Tezisy Dokl. Vses. Konf. Khim. Ispolz Lignina' 6th 1975 (pub 1976) pp 122–5 (USSR).
2. E. I. Kovalenko et al 'Tr. Novocherk Politeckh Inst' 320 69–73
3. E. I. Kovalenko et al 'Zh. Prikl. Khim' 50 (8) 1741–1744 (1977).
4. L. V. Bronov et al 'Khim Drev' (1) 40–44 (1976).

We claim:

1. A process for the cleavage of lignin at a yield greater than 6% wherein by passage of an electric current through an aqueous alkaline solution of the lignin at a temperature above 100° C. whilst maintaining mixing of the soluton the lignin is cleaved into smaller molecules than the starting lignin.

2. A process as claimed in claim 1 characterised in that the alkali is an alkali metal hydroxide.

3. A process as claimed in claim 2 characterised in that the concentration of alkali is 2.5–3.5M.

4. A process as claimed in claim 1 characterised in that the temperature is 170°–190° C.

5. A process as claimed in claim 1 characterised in that the current density is 0.2–10 $mAcm^{-2}$.

6. A process as claimed in claim 5 characterised in that the current density is 3–5 $mAcm^{-2}$.

7. A process as claimed in claim 1 characterised in that the cathode is selected from the group consisting of nickel, copper, vitreous carbon and lead and the anode is selected from the group consisting of copper, vitreous carbon and nickel.

8. A process as claimed in claim 7 characterised in that both the cathode and the anode are made of nickel.

9. A process as claimed in claim 1 characterised in that the lignin is subjected to prehydrolysis prior to passage of the electric current.

10. A process as claimed in claim 9 characterised in that the prehydrolysis is carried out above 100° C. using an aqueous alkali metal hydroxide.

11. A process as claimed in claim 10 characterised in that pre-hydrolysis is carried out at 170°–180° C.

12. A process as claimed in claim 1 applied to spruce, straw, organosolv, bagasse, aspen or HF lignin or lignin derived from wood pulp processing.

* * * * *